United States Patent [19]

Collins, Jr. et al.

[11] Patent Number: 4,952,136

[45] Date of Patent: Aug. 28, 1990

[54] BURNER ASSEMBLY FOR OIL FIRED FURNACES

[75] Inventors: Raymond L. Collins, Jr., Hudson; Stephen A. Bryk, Mogadore, both of Ohio

[73] Assignee: Control Systems Company, Stow, Ohio

[21] Appl. No.: 263,712

[22] Filed: Oct. 28, 1988

Related U.S. Application Data

[63] Continuation of Ser. No. 49,804, May 12, 1987, abandoned.

[51] Int. Cl.[5] ..... F23M 9/00

[52] U.S. Cl. ..... 431/183; 431/9; 431/10; 431/154; 431/159; 431/174; 431/187; 431/354

[58] Field of Search ..... 431/2, 8, 9, 10, 154, 431/159, 174, 175, 181, 182, 183, 185, 187, 188, 278, 284, 351, 354; 239/406, 419, 427, 427.3

[56] References Cited

U.S. PATENT DOCUMENTS

| | | | |
|---|---|---|---|
| 1,888,385 | 11/1932 | Jenkins | 239/419 X |
| 2,046,767 | 7/1936 | Campbell | 110/22 |
| 2,212,004 | 0/1940 | Beathcaome et al. | 131/187 |
| 2,233,529 | 3/1941 | Herr | 158/76 |
| 2,386,178 | 11/1945 | Turpin | 431/284 |
| 2,414,459 | 1/1947 | Fletcher | 431/174 |
| 2,458,541 | 1/1949 | Urquhart | 431/188 X |
| 2,480,547 | 8/1949 | Casacristi | 431/188 |
| 2,518,025 | 8/1950 | Knight | 431/187 |
| 2,623,786 | 12/1956 | Wille | 239/427.3 |
| 2,758,636 | 0/1956 | Hubbard | 431/183 |
| 2,796,723 | 6/1957 | Fiske et al. | 431/183 |
| 2,803,296 | 8/1957 | Young | 158/76 |
| 2,815,069 | 12/1957 | Garraway | 431/188 |
| 3,042,105 | 7/1962 | Bitterlick | 431/174 |
| 3,452,933 | 7/1969 | Hakluytt | 239/399 |
| 3,498,544 | 3/1970 | Hakluytt | 239/404 |
| 3,761,243 | 0/1973 | Zink et al. | 431/181 |
| 3,775,039 | 11/1973 | Pillard | 431/350 |
| 3,832,121 | 0/1974 | Metz et al. | 43/181 |
| 4,047,879 | 0/1977 | Mitchell et al. | 431/173 |
| 4,057,021 | 11/1977 | Schoppe | 110/28 A |
| 4,141,505 | 2/1979 | Reich | 239/431 |
| 4,221,558 | 9/1980 | Santisi | 431/183 |
| 4,243,375 | 1/1981 | Reed | 431/174 |
| 4,270,895 | 6/1981 | Vatsky | 431/183 |
| 4,274,343 | 6/1981 | Kokkinos | 110/263 |
| 4,379,689 | 4/1983 | Morck, Jr. | 431/284 |
| 4,431,403 | 2/1984 | Nowak et al. | 431/183 |
| 4,448,135 | 5/1984 | Dougan et al. | 110/263 |
| 4,457,241 | 7/1984 | Itse et al. | 110/347 |
| 4,471,703 | 9/1984 | Vatsky et al. | 110/263 |
| 4,497,263 | 2/1985 | Vatsky et al. | 110/347 |
| 4,559,009 | 12/1985 | Marino et al. | 431/184 |
| 4,611,543 | 9/1986 | Collette | 110/263 |
| 4,627,366 | 12/1986 | LaRue et al. | 110/263 |
| 4,654,001 | 3/1987 | LaRue | 431/354 |
| 4,664,619 | 5/1987 | Johnson et al. | 431/154 |
| 4,685,882 | 8/1987 | Binasik et al. | 431/182 |

FOREIGN PATENT DOCUMENTS

| | | | |
|---|---|---|---|
| 75378 | 2/1953 | Denmark | 239/419 |

*Primary Examiner*—Carl D. Price

*Attorney, Agent, or Firm*—Renner, Kenner, Greive Bobak, Taylor & Weber

[57] ABSTRACT

A burner assembly (75) for the combustion of liquid fuels in furnaces (12) and the like. The assembly comprises fuel gun means (78) for creating a mixture of combustible fuel and an atomizing medium and injecting a stream of the mixture into the interior of a furnace; housing means (76) supporting the fuel gun means, attachable to the furnace, so that the combustible fuel mixture is delivered to the interior of the furnace for combustion and for supplying a first flow of air (B) into the furnace separate from the air mixed with the fuel to encompass the injected fuel mixture; and swirler means (79) having a plurality of blades (94) interposed within the housing means so that the first flow moves around and through the blades for imparting a rotation to the first flow of air to break up the stream of fuel mixture. Related burner assemblies (10,110,160) of the present invention also provide holding tube means (39,125,173) for supplying a second flow of air and a burner assembly (110) provides first and second swirler means (113,136). A method for supplying fuel and air mixtures to furnaces and the like through burner assemblies is also provided and results in increased combustion efficiency. An improved atomizer tip (215) and a method for atomized liquid fuel is also provided and can be used with burner assemblies of the present invention as well as those of existing design.

31 Claims, 9 Drawing Sheets

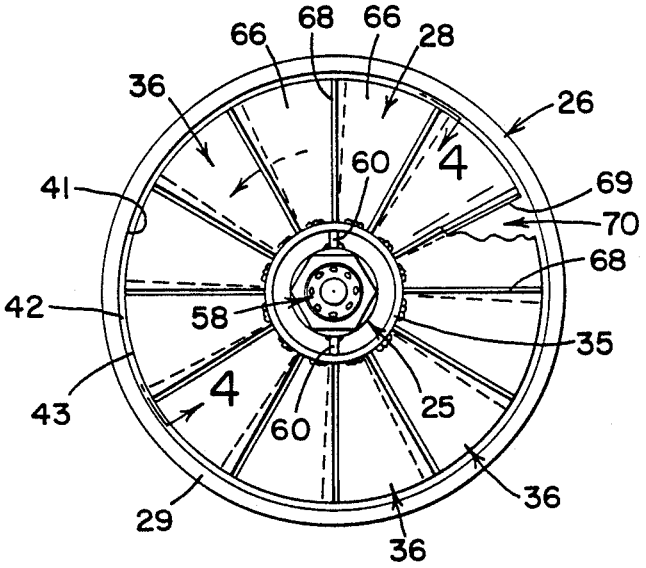
FIG. 3
FIG. 11
(PRIOR ART)
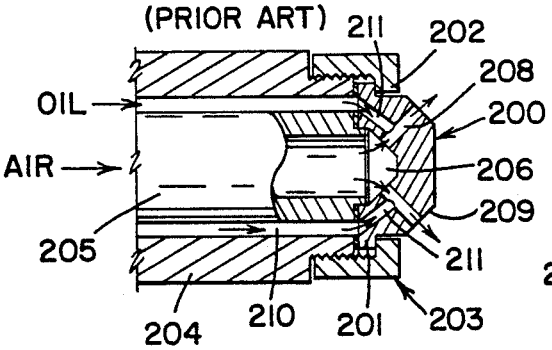
FIG. 12
(PRIOR ART)
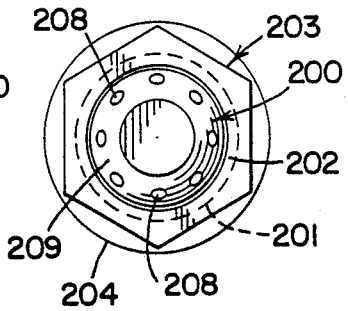
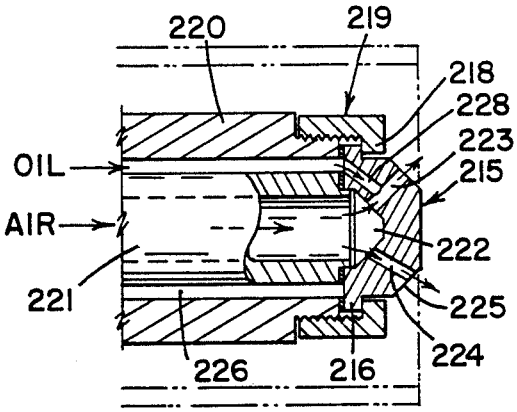
FIG. 13
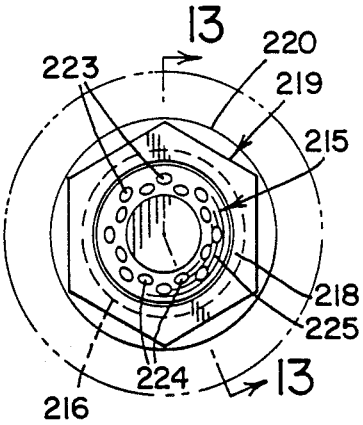
FIG. 14

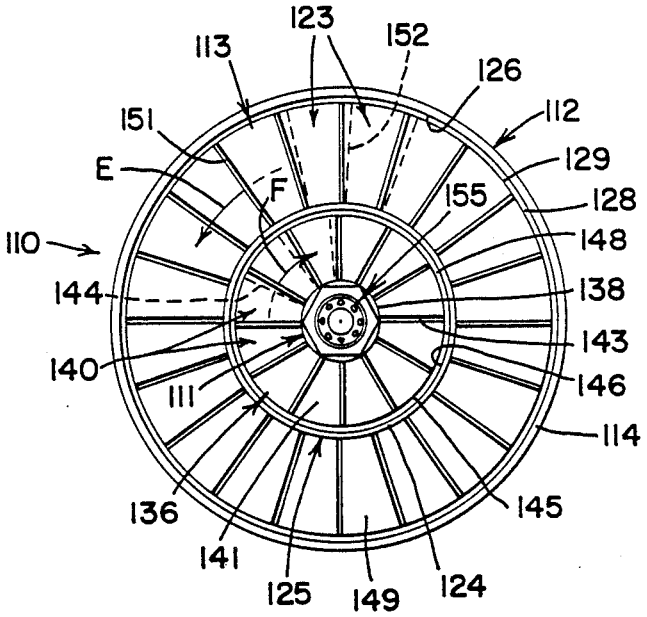
FIG. 9
FIG. 4
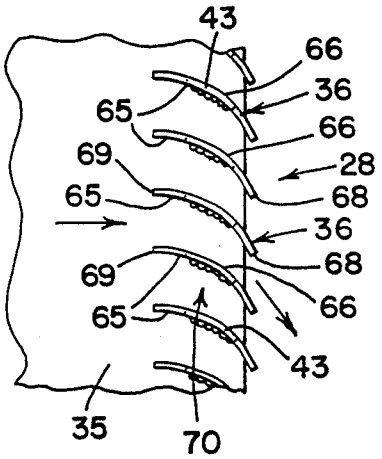

BURNER ASSEMBLY FOR OIL FIRED FURNACES

This is a continuation of application Ser. No. 07/049,804 filed on May 12, 1987, now abandoned.

TECHNICAL FIELD

The present invention is directed toward burner assemblies, or lighters or ignitors as they are sometimes known, for large steam generating units, viz., boilers. Each assembly provides an oil gun for the combustion of fuel oil in furnaces where water is heated to generate steam heat and power in boilers. Such boilers are typically found on land for power generation or heat production. Much smaller boilers are used on marine vessels. The burner is fired by oil which has been atomized and mixed with air or other compressible medium.

BACKGROUND ART

Typically, the furnace walls are lined with water tubes, pipes through which water is circulated, heated and converted into steam and collected in a large drum usually above the furnace. In order to heat large quantities of water, multiple burner assemblies can be employed which are inserted through at least one wall of the furnace or at each of the corners, or roof mounted, depending upon the designs of the manufacturer. The burners are at least positioned so that combustion occurs at or near the center of the furnace interior so that the heat is more evenly spread.

The oil fuel is atomized by each gun and enters the furnace as a spray. There it is initially ignited by an ignitor probe which provides a short succession of electric discharges from its tip to cause initial combustion of the oil which thereafter continues as the oil is fed. In addition to the air which may be used to atomize the oil, other air is supplied through an air or wind box and is circulated within a larger conduit through which the oil gun is centered. This air enters the furnace concentrically with the atomizer tip of the oil gun to provide a source of air for proper combustion. Additionally, other air can be fed into the furnace from sources other than that of the atomizer tip.

The air is intended to insure complete as well as controlled combustion of the oil. Controlled combustion means that the flame should begin at or near the atomizer tip and extend to the center of the furnace interior in a large, bushy shape. When the combustion is not properly controlled, the flame may not begin until some distance from the tip and then it may burn with a narrow shape appearing more as a jet or torch. When this occurs, some quantity of the fuel is not combusted and it will either fall to the furnace floor or be carried through the furnace and become deposited on various heat transfer surfaces. The latter creates the potential for catastrophic air heater fires and the like. As to the combusted quantity, it may provide a flame beyond the center of the furnace which provides uneven heating and in extreme occasions it could focus on several of the tubes on the far wall which can lead to premature failure. In addition, for a specified heat input it is known that a narrow, pencil-like flame cannot provide the same amount of energy as a large bushy flame.

To overcome many of these deficiencies in flame control, multiple burner assemblies are provided as previously noted. Also, the supply of air, which is fed at controllable rates, is adjusted to provide more or less quantity within the furnace to bring the flame back to the atomizer tip and also to spread out its shape. Fans provide the combustion air and it is the circulation of air around the oil gun that is critical for proper flame development and stability. Existing burner assemblies have used various combinations of holes and air swirling devices in an attempt to create a structured turbulence that encompasses the oil spray and penetrates it to provide sufficient air at each oil particle in the expectation that complete and maximum combustion will occur.

Despite the years that burner assemblies have been employed and the many design variations, flame adjustment or control can take much time or fuel is wasted and in some instances, maximum combustion efficiency is never obtained. More complex assemblies may increase selective combustion efficiency components but these are more labor intensive and require longer down time of the furnace when work is required on the oil gun which must be periodically removed, disassembled and cleaned or replaced.

DISCLOSURE OF THE INVENTION

It is therefore an object of the present invention to provide a burner assembly for furnaces and the like wherein fuel is combusted to generate heat and steam.

It is another object of the present invention to provide a burner assembly that provides more complete combustion of the fuel.

It is another object of the present invention to provide a burner assembly that provides a controlled, improved flame pattern.

It is yet another object of the present invention to provide a burner assembly that is more efficient and is less costly to service and maintain.

It is yet another object of the present invention to provide an improved atomizer tip for burner assemblies.

It is still another object of the present invention to provide a method whereby combustion efficiency of liquid fuel(s) and air mixtures is improved.

It is a further object of the present invention to provide a method for combustion whereby flame pattern is controlled and improved.

These and other objects, together with the advantages thereof over known burner assemblies, which shall become apparent from the specification which follows, are accomplished by the invention as hereinafter described and claimed.

In general, a burner assembly for the combustion of liquid fuels in furnaces and the like comprises fuel gun means for creating a mixture of combustible fuel and an atomizing medium and injecting a stream of the mixture into the interior of the furnace; housing means carrying the fuel gun means, attachable to the furnace, so that the combustible fuel mixture is delivered to the interior of the furnace for combustion and supplying a first flow of air into the furnace to encompass the injected fuel mixture therein, holding tube means for supplying a second flow of air into the furnace interior separate from the first flow of air and, swirler means having a plurality of blades interposed within the housing means so that the first flow moves around and through the blades to impart a rotation to the first flow of air to break up the stream of fuel mixture.

The present invention also provides a related burner assembly for the combustion of liquid fuels in furnaces and the like comprises fuel gun means for creating a mixture of combustible fuel and an atomizing medium and injecting a stream of the mixture into the interior of the furnace; housing means supporting the fuel gun means, attachable to the furnace, so that the combustible fuel mixture is delivered to the interior of the furnace for combustion and supplying a first flow of air into the furnace to encompass the injected fuel mixture therein and, swirler means having a plurality of blades interposed within the housing means so that the first flow moves around and through the blades to impart a rotation to the first flow of air to break up the stream of fuel mixture.

The present invention also provides a method for supplying fuel and air mixtures to furnaces and the like through a burner assembly which results in increased combustion efficiency. Such a method comprises the steps of injecting a mixture of fuel and an atomizing medium from a fuel gun into the interior of the furnace; feeding a first flow of air through the burner assembly and into the furnace interior; interrupting the first flow of air so that a portion thereof moves axially forward into the furnace interior while another portion is imparted a rotation and, encompassing the mixture with the first flow of air as the mixture enters the furnace, whereby both portions of the first flow of air break up the mixture within the furnace.

An improved atomizer tip for mixing a separate supply of air with a separate supply of fuel is also provided. It comprises first and second pluralities of narrow air passageways extending through the atomizer tip for the movement of air therethrough, and a plurality of narrow oil passageways for the movement of fuel. The oil passageways communicate with the first plurality of air passageways within the atomizer tip whereby the fuel becomes atomized by the air as it is ejected from the first plurality of air passageways and becomes mixed with the air ejected from the second plurality of air passageways upon ejection from the first plurality of air passageways.

An improved method for atomizing liquid fuel is also provided and includes the steps of forcing a volume of air through first and second pluralities of narrow air passageways provided in an atomizer tip and extending therethrough; forcing a volume of fuel through a plurality of narrow oil passageways which communicate with the first plurality of air passageways; ejecting a mixture of atomized fuel and air from the first plurality of air passageways and, dispersing air from the second plurality of air passageways into the mixture of atomized fuel and air.

BRIEF DESCRIPTION OF THE DRAWINGS

FIG. 3 is a frontal elevation, taken substantially along line 3—3 of FIG. 2, depicting the air swirler from the burner assembly of FIG. 2;

FIG. 4 is a developed view, taken substantially along the line 4—4 of FIG. 3, of a segment of the swirler component depicting a plurality of blades thereof;

FIG. 9 is a frontal elevation, taken substantially along line 9—9 of FIG. 8, depicting the twin air swirlers from the burner assembly of FIG. 7;

FIG. 11 is a cross-sectional view depicting an existing atomizer tip;

FIG. 12 is a front elevation of the atomizer tip of FIG. 11;

FIG. 13 is a cross-sectional view, taken substantially along line 13—13 of FIG. 14, depicting an improved atomizer tip;

FIG. 14 is a front elevation of the improved atomizer tip;

PREFERRED EMBODIMENT FOR CARRYING OUT THE INVENTION

Figure 1:
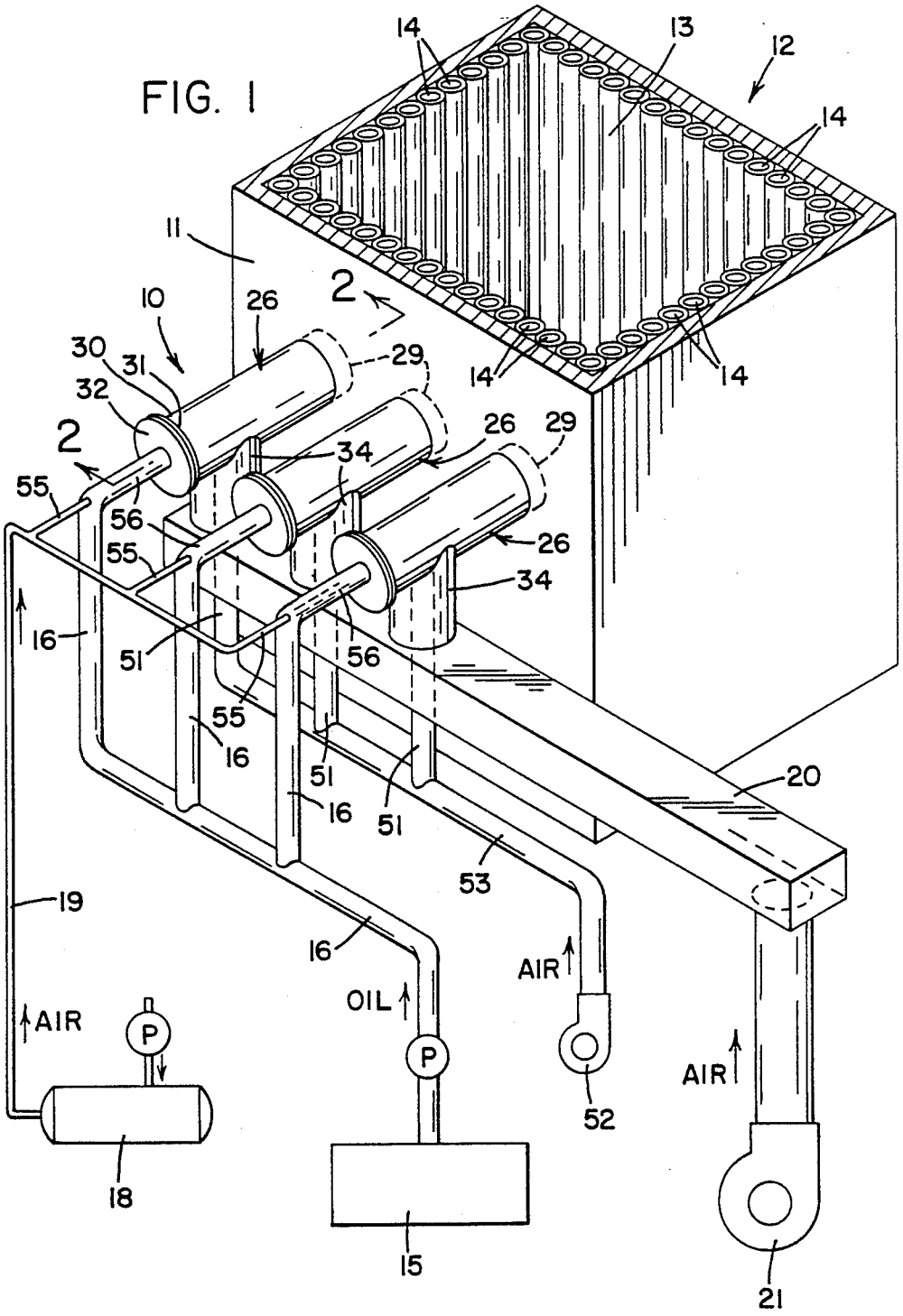
FIG. 1 is an overall perspective view of a furnace for steam generation depicting a configuration of three burner assemblies with fuel and air supplies.

Four embodiments of burner assemblies are provided by the present invention. Variations among the assemblies allow for the design most particularly suited for a given type of furnace to be employed. With reference to FIG. 1, a trio of burner assemblies, generally referred to by the numeral 10 is depicted mounted on and through a wall 11 of a furnace 12. The furnace interior 13 is lined along its walls with a plurality of tubes 14 through which water is circulated, heated and converted to steam.

It will be appreciated that FIG. 1 is only illustrative of furnaces in general having water/steam tubes and that for clarity and discussion the top of the furnace has not been shown, nor has any steam drum or means for circulating steam and returning water been presented. The present invention is not directed toward furnaces or the generation of steam, per se, only improved burner assemblies that can be employed therewith. Thus, it is to be understood that practice of the present invention is not limited to the use of three burner assemblies or any other plurality; nor is the use of one precluded. Moreover, the assemblies can be mounted in a side wall, as depicted, or at the corners of the furnace, as is known.

Oil or other liquid fuel is supplied from a tank 15 and is pumped through pipes 16 to an oil gun described hereinbelow. Compressed air or steam is also fed to the fuel from an air compressor or proper steam source 18 and pipes 19. Inasmuch as it is known to mix air or steam with liquid fuel in the atomizer of a burner assembly, reference to the term air in conjunction with the fuel gun shall be understood to mean air or steam or for that matter, any other compressible atomizing medium unless otherwise stated. The atomizing medium, such as steam, helium or the like, need not support combustion as the primary function is to atomize the liquid fuel.

Wind box 20, is also provided which serves as a manifold to supply large quantities of air via fan 21 to each of the burner assemblies and, in turn, the furnace interior for combustion. Each of the burner assemblies is suitably affixed to a port in the furnace wall such as by bolts and flanges (not shown) which permit disassembly and re-installation or replacement of the assembly. Before describing each of the burner assemblies in greater detail, it is to be understood that any of the four burner assemblies embodied herein could be employed with furnace 12 or one of similar design for burning oil and other liquid fuels.

Figure 2:
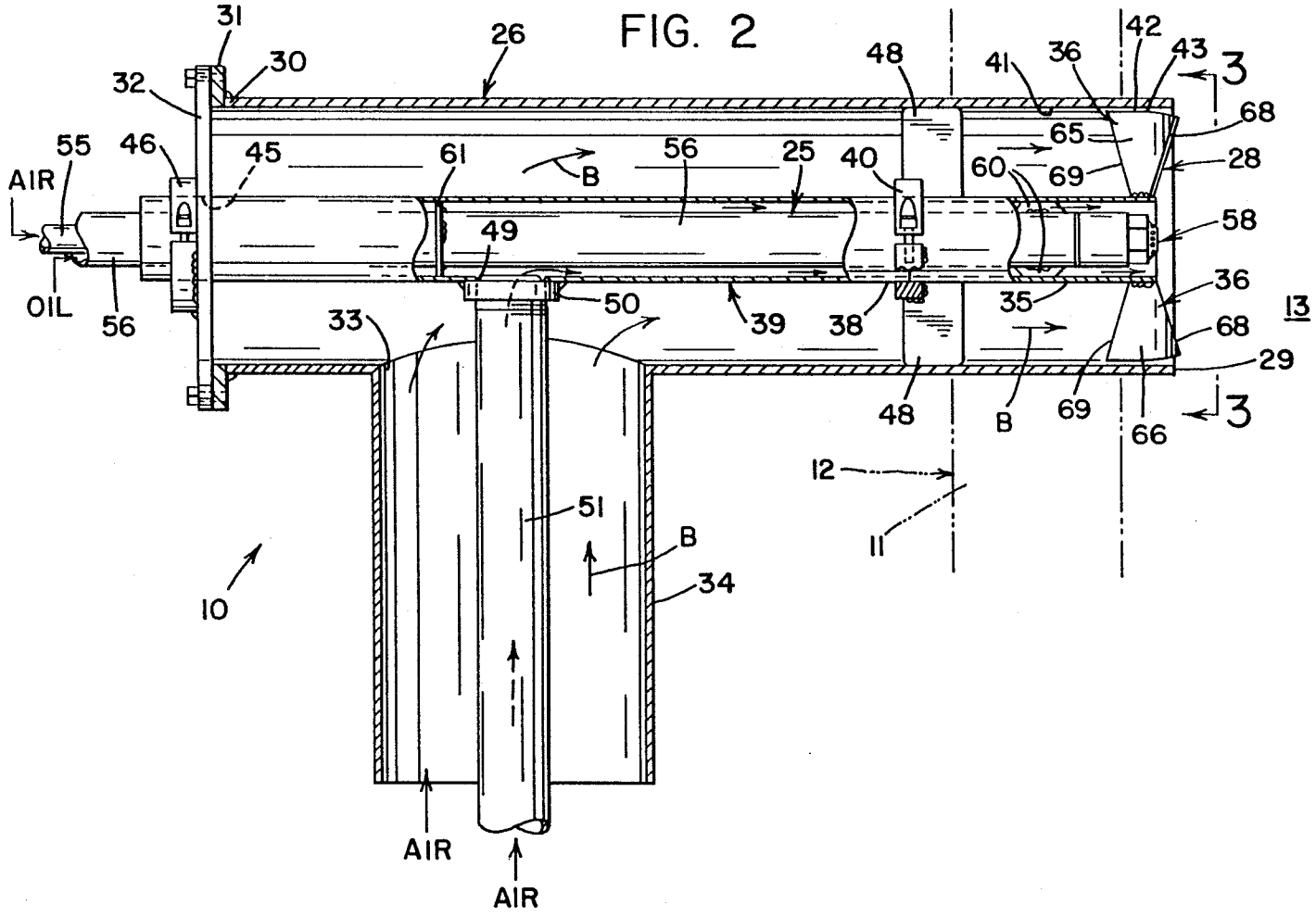
FIG. 2 is an enlarged side elevation, partially in section, and taken substantially along line 2—2 of FIG. 1, depicting one embodiment of burner assembly according to the present invention.

With reference to FIG. 2, the first burner assembly 10 is depicted. It comprises a fuel or oil gun 25, housing means 26 by which the oil gun 25 is supported and a first supply of air is supplied and an air swirler 28. The housing member 26 is a large metal tube having a diameter of between eight and 16 inches (20 to 40 cm). It is to be understood that burner assembly 10 is not necessarily limited by these dimensions, however. Housing member 26 passes through the furnace wall 11 and is open at end 29 to the furnace interior. At the opposite end 30, a flange 31 is provided to which a closure plate 32 is removably affixed. An opening 33 in the side of the housing receives a leg 34 which is connected to the air box 20 and receives a large volume of air. The leg 34 is generally not removable from the housing 26. Moreover, the leg can be affixed at an angle to the tube 26 or perpendicularly, as shown.

It can be seen in FIG. 2 that a first volume of air is fed into the housing 26 through the leg 34 to exit out the end 29 directly into the furnace interior. Rather than deliver a forward moving blast of air, the swirler 28 is provided in the opening. The swirler, which comprises a cylindrical hub 35 and a plurality of blades 36, is removably affixed to the end 38 of a holding tube 39 with a clamping device 40. The blades 36 extend radially outwardly toward the inner wall 41 of housing 26.

A narrow axial space 42 is provided between the outermost edge 43 of each blade 36 and inner wall 41. This space is important for it allows some of the air moving through housing 26 to travel around the swirler 28 and continue in an axial flow. The diameter of existing swirlers has been considerably less than the inner diameter of housing member 26 and an outer annular ring encompasses the blade edges 43. Thus, significant amounts of the axially moving air passing through housing 26 flow around the swirler. By increasing the diameter of the swirler 28 to substantially that of the housing 26, greater control over the flame pattern has resulted as well as improved combustion efficiency. Elimination of the outer ring and provision of the space 42 allows some of the air to flow around the swirler which also contributes to greater control and efficiency.

The holding tube 39 passes through a bore 45 in the closure plate 32. A suitable fastening device 46 can be employed to maintain tube 39 in position. One or more spiders 48 can also be employed to support tube 39. An opening 49 in the side of tube 39 is provided with a flange 50 to which a separate air line 51 is connected. As seen in the drawings, the air line 51 can readily be positioned within leg 34. It can receive air from the wind box 20 or from a separate air supply, such as the fan 52 and line 53 shown in FIG. 1.

The oil gun 25 is a conventional element and includes an air or steam line 55 which passes concentrically within an oil line 56. Both the air and fuel pass separately through the gun until reaching the atomizer tip 58 where mixing takes place by atomization of the oil which is injected under pressure as a stream into the furnace interior 13. It is also possible to pass the oil line concentrically within the air line and then employ a distributor plug or similar element to direct the oil flow to the outside and the air flow inside just prior to reaching the atomizer tip. Although the present invention can employ an improved atomizer tip, to be described hereinbelow, generally speaking, the oil gun 25 having a standard atomizer 58 can be utilized with the burner assembly 10.

The oil gun 25 is centered within the holding tube 39 by one or more spiders 60. A baffle plate 61 is welded to the pipe 56 to form a seal within holding tube 39 so that the flow of air from the line 51 will travel along the oil gun to be released within the atomized fuel mixture.

With reference to FIGS. 3 and 4, the swirler 28 is depicted in greater detail. Each blade 36 is curved to present a concave rear face 65 and a convex front face 66 which is directed toward the furnace interior. Each blade also presents a trailing edge 68 toward the furnace interior and a leading edge 69 which is confined within the housing member 26. The blades are each affixed to the hub 35 in an overlapping configuration so that the trailing edge 68 of one blade overlaps the leading edge 69 of the next blade.

In this manner, air passing through the housing member 26 cannot pass straight through any of the blades but first contacts the rear faces 65. As the air moves around the leading edge 69 of a blade, its path is next impeded by the trailing edge 68 of an adjacent blade. Because the blades are each curved, the air is given a curved slotted passageway 70 through which to flow which imparts a rotational movement to the air as it enters the furnace. In order to ease the movement of the air into the swirler, each of the leading edges 69 is essentially parallel to the flow of air, as depicted in FIG. 4. Although FIG. 4 has been developed from FIG. 3, it is characteristic of the other swirlers to be discussed hereinafter.

Figure 5:
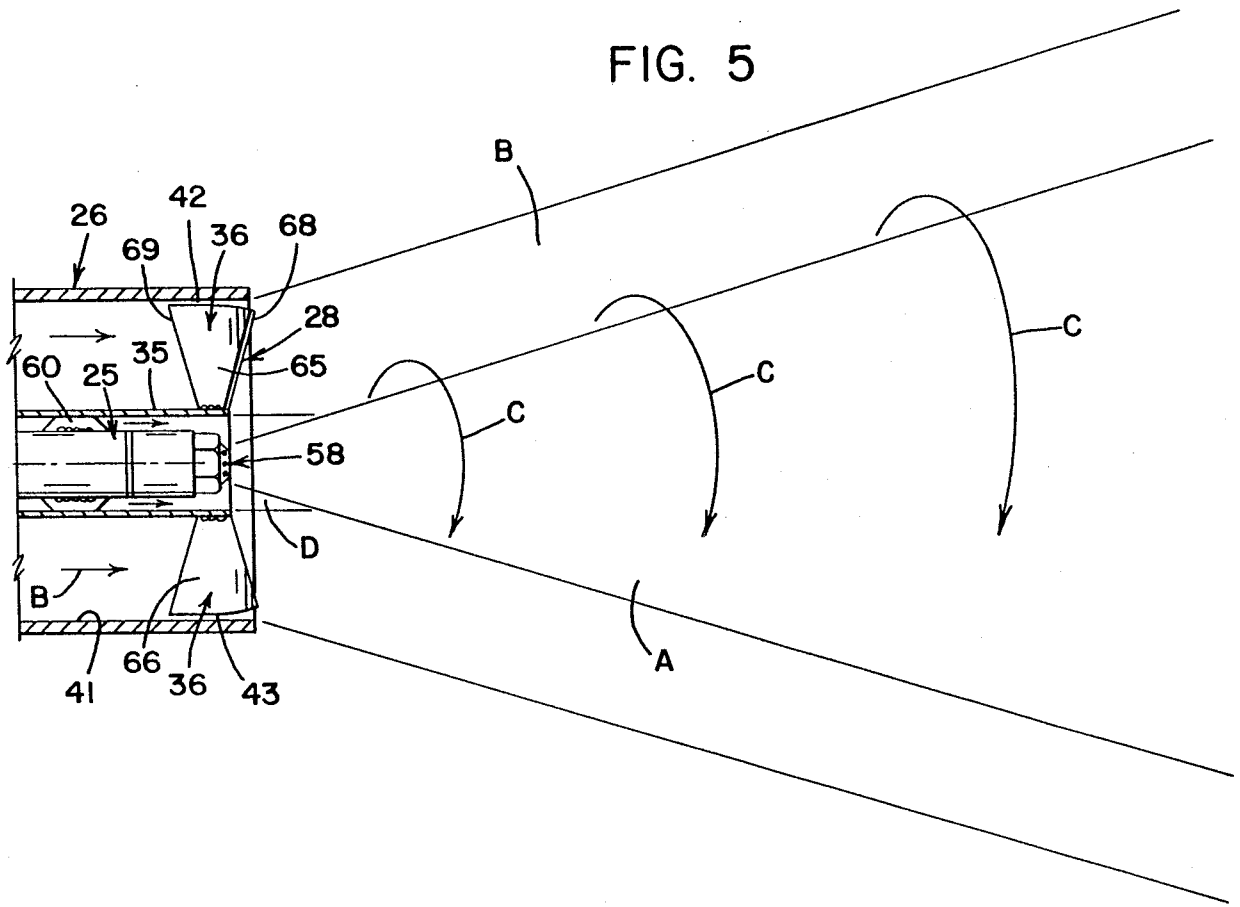
FIG. 5 is a diagrammatic view of the air and of the fuel mixture emanating from the tip of a burner assembly of the present invention.

At this point, reference is drawn to FIG. 5 which depicts, diagrammatically the various flow patterns. First, the oil and air mixture is seen exiting the atomizer 58 where it fans outwardly to form an expanding cone A. The large volume of air B passing through the housing member 26 contacts the swirler 28 and encompasses the atomized fuel cone A, in a separate cone B. The air in cone B rotates in the direction of the arrows C and helps to disperse the fuel cone A with air. Simultaneously, a narrow, forward moving volume of air is delivered through the cylindrical hub 35 at D, where it also passes directly into the cone A, as it just begins to emerge and expand, helping to slice it open and expand it further as the swirler air, cone B slices into it. All of this results first in a heavy concentration of air directly at the atomizer tip. Second, rather than move forwardly, which would confine cone A, the air components B and D penetrate the fuel cone, dispersing the atomized fuel particles with air to maximize combustion efficiency.

Figure 6:
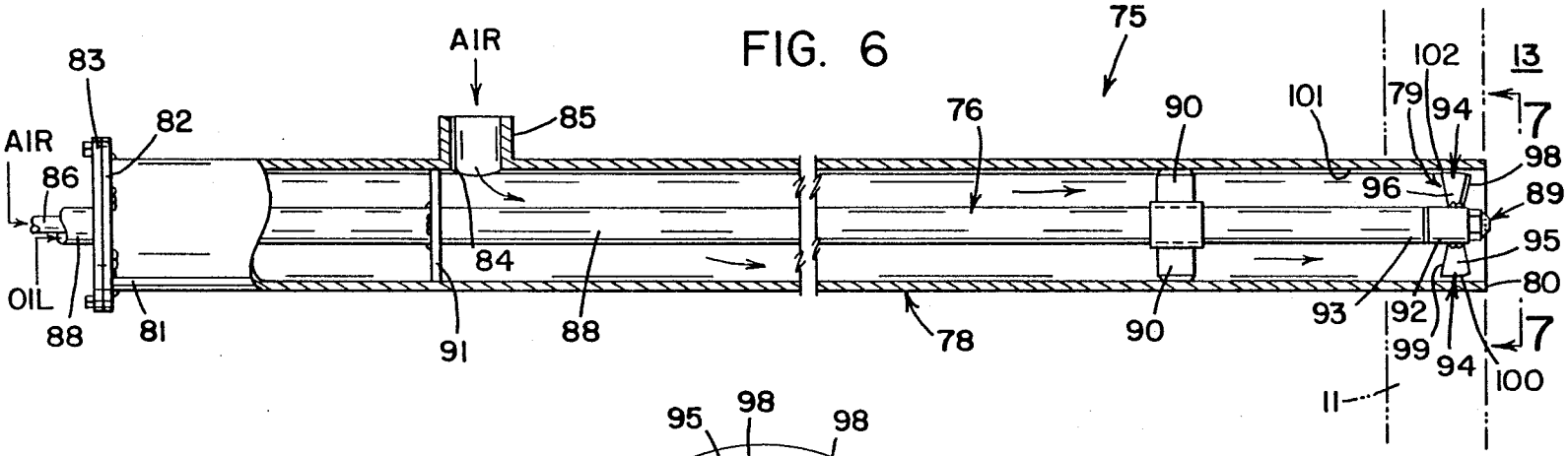
FIG. 6 is an enlarged side elevation, partially in section, depicting a second embodiment of burner assembly according to the present invention.
Figure 7:
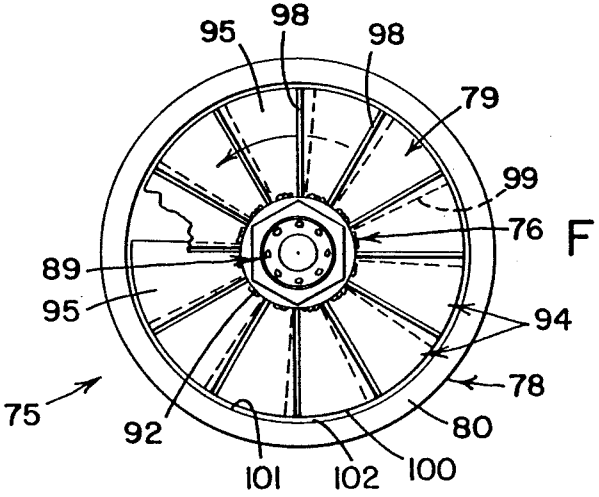
FIG. 7 is a frontal elevation, taken substantially along line 7—7 of FIG. 6, depicting the air swirler from the burner assembly of FIG. 6.

With reference next to FIGS. 6 and 7, a second embodiment shall be described. The burner assembly, indicated generally by the numeral 75 comprises a fuel or oil gun 76, housing means 78, which supports oil gun 76 and provides a supply of air, and an air swirler 79. The housing member 78 is again a metal tube having a diameter between four to six inches (10 to 12.5 cm). It is to be understood that burner assembly 75 is not necessarily limited by these dimensions. Nevertheless, the burner assembly 75 is much smaller than the assembly 10 and is employed with smaller furnaces or those requiring less input or where the application cannot accommodate larger burners.

The housing member 78 also passes through the furnace wall 11 and is open at end 80 to the furnace interior. At the opposite end 81, a flange 82 is provided to which a closure plate 83 is removably affixed. An opening 84 in the side of the housing receives a leg 85, which is connected perpendicularly or at an angle, and which receives air from the wind box 20 as discussed hereinabove.

The oil gun 76 is again a conventional element, including an air line 86, oil line 88 and atomizer tip 89. Inasmuch as these elements are the same as those previously described in conjunction with the oil gun 25 of FIG. 2, further detail is not necessary. The oil gun 76 is centered within the housing member 78 by one or more spiders 90. A baffle plate 91 is welded to the oil line 88 to form a seal behind the opening 84 so that the flow of air fed through the leg 85 will travel along the oil gun to be released with the atomized fuel mixture.

As the air moves through the housing member, it contacts the swirler 79 which is mounted directly to the atomizer tip capnut 92 affixed to the end 93 of the gun 76. Swirler 79 includes a plurality of blades 94 radiating outwardly therefrom. Each blade 94 presents a convex front face 95, a concave rear face 96 and overlapping trailing and leading edges, 98 and 99 respectively. The outermost edges 100 terminate a short distance from the inner wall 101 of the housing member 78 to provide an axial space 102 so that the air passing through member 78 moves through the blades 94 as well as around the edges 100. Again, the design of the swirler essentially fills the housing member 78 and no outer ring is employed.

In this embodiment, the size of the oil gun and overall burner assembly is such that the only additional air needed can be supplied through the housing member and thus, a separate supply is not also provided. Forward moving air does pass through the axial space 102 in sufficient volume to help mix with the fuel cone in addition to the rotating volume of air that passes through the swirler 79.

Figure 8:
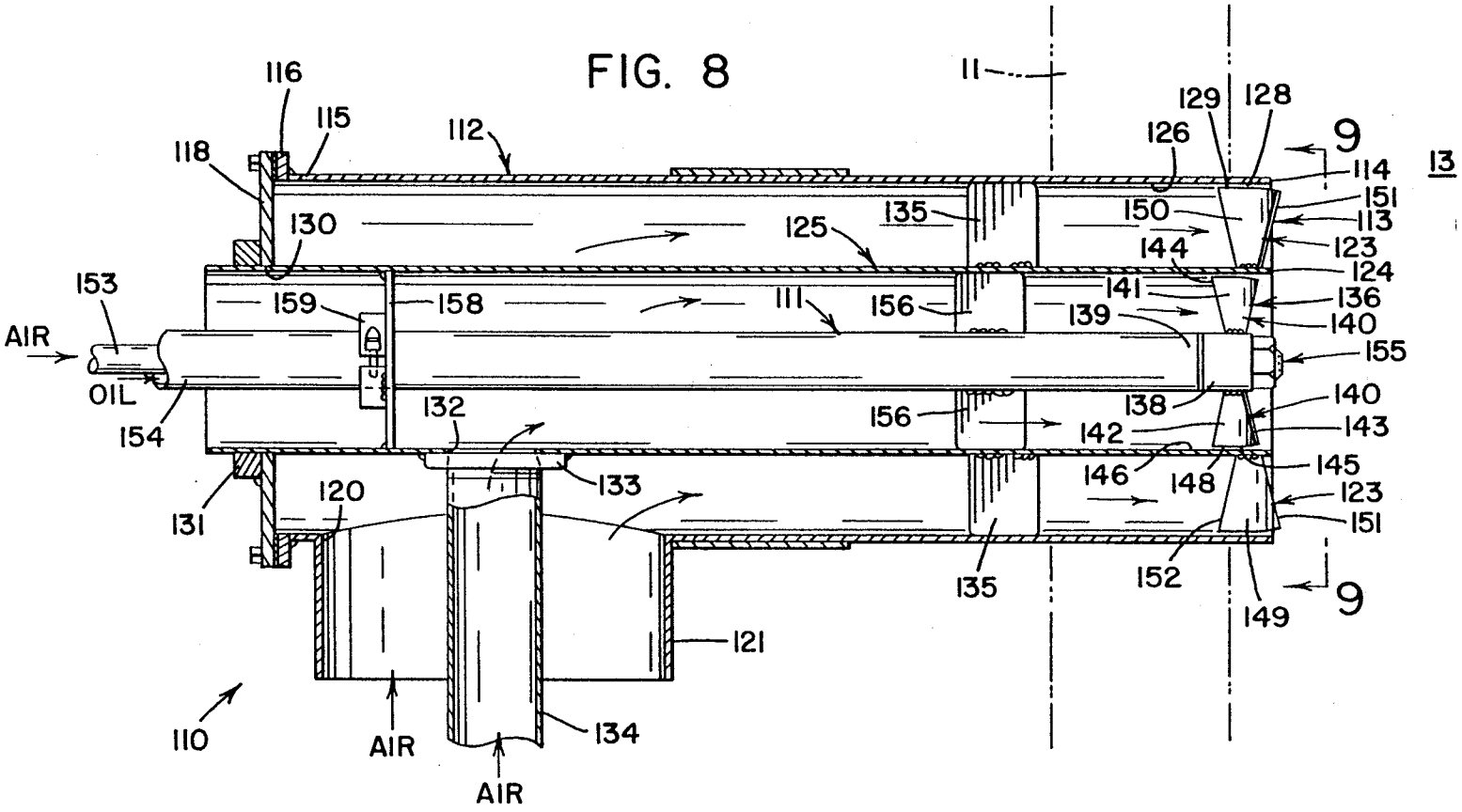
FIG. 8 is an enlarged side elevation, partially in section, depicting a third embodiment of burner assembly according to the present invention.

With reference next to FIGS. 8 and 9, a third embodiment shall be described. The burner assembly, indicated generally by the numeral 110, comprises a fuel or oil gun 111, housing means 112 by which the oil gun 111 is supported and a first supply of air is supplied and an air swirler 113. The housing member 112 is a large metal pipe having a diameter of between 12 and 24 inches (30 to 60 cm). It is to be understood that the burner assembly 110 is not necessarily limited by these dimensions. Housing member 112 passes through the furnace wall 11 and is open at end 114 to the furnace interior. At the opposite end 115, a flange 116 is provided to which a closure plate 118 is removably affixed. An opening 120 in the side of the housing receives a leg 121 which is connected to the air box 20 and receives a large volume of air. The leg 121 is affixed to the housing 112 perpendicularly, as shown, or at an angle.

It can be seen in FIG. 8 that a first volume of air is fed into the housing 112 through the leg 121 to exit out the end 114 directly into the furnace interior. Rather than deliver a forward moving blast of air, the swirler 113 is provided in the opening. The swirler, which comprises a plurality of blades 123, is affixed to the end 124 of a holding tube 125. The blades 123 extend radially outwardly toward the inner wall 126 of housing 112.

A narrow axial space 128 is provided between the outermost edge 129 of each blade 123 and inner wall 126 to allow some of the air moving through housing 112 to flow around the swirler 113. Again, use of a larger diameter swirler, the elimination of an outer ring around the blades and provision of the space 128 has resulted in greater control over the flame pattern and efficiency of the combustion.

The holding tube 125 passes through a bore 130 in the closure plate 118. A suitable fastening device 131 can be employed to maintain tube 125 in position. An opening 132 in the side of tube 125 is provided with a flange 133 to which a separate air line 134 is connected. One or more spiders 135 can be employed to support the tube 125 within housing member 112. As seen in the drawing, the air line 134 is positioned within leg 121 so that it too receives air from the wind box 20, which eliminates the need for a separate air supply, although one could be employed such as the fan 53 shown in FIG. 1, discussed hereinabove.

Because of the large sizes involved, the holding tube 125 can also carry a swirler 136. Thus, the burner assembly 110 combines elements of the burner assemblies 10 and 75. The swirler 136 is mounted directly to the atomizer tip capnut 138 affixed to the end 139 of the oil gun 111. Swirler 136 includes a plurality of blades 140 radiating outwardly therefrom. With reference to FIG. 9, each blade 140 presents a convex front face 141, a concave rear face 142 and overlapping trailing and leading edges, 143 and 144, respectively. The outermost edges 145 terminate a short distance from the inner wall 146 of the holding tube 125 to provide an axial space 148 so that the air passing through holding tube 125 moves through the blades 140 as well as around the edges 145.

In similar fashion, the blades 123 of swirler 113 are curved to present a convex front face 149, a concave rear face 150 and overlapping trailing and leading edges, 151 and 152 respectively. The orientation of the blades 123 of swirler 113 is such that the air movement is counterclockwise, as depicted by the arrow E, while the blades 140 of the inner swirler 136 are oriented to move the air in the opposite direction or clockwise, as depicted by the arrow F. The counter-rotating air flows and axial flow around swirlers 113 and 136 effects very efficient mixing of the air and the fuel cone in large burners.

Once again, the oil gun 111 is a conventional element, including an air line 153, oil line 154 and atomizer tip 155. Inasmuch as these elements are the same as those previously described in con]unction with the oil gun 25 of FIG. 2, further detail is not necessary. The oil gun 111 is centered within the holding tube 125 by one or more spiders 156 and is clamped to the baffle plate 158 by clamp collar 159. The baffle plate 158 is welded to the tube 125 to form a seal behind the opening 132 so that the flow of air fed through the leg 134 will travel along the oil gun to be released with the atomized fuel mixture.

Figure 10:
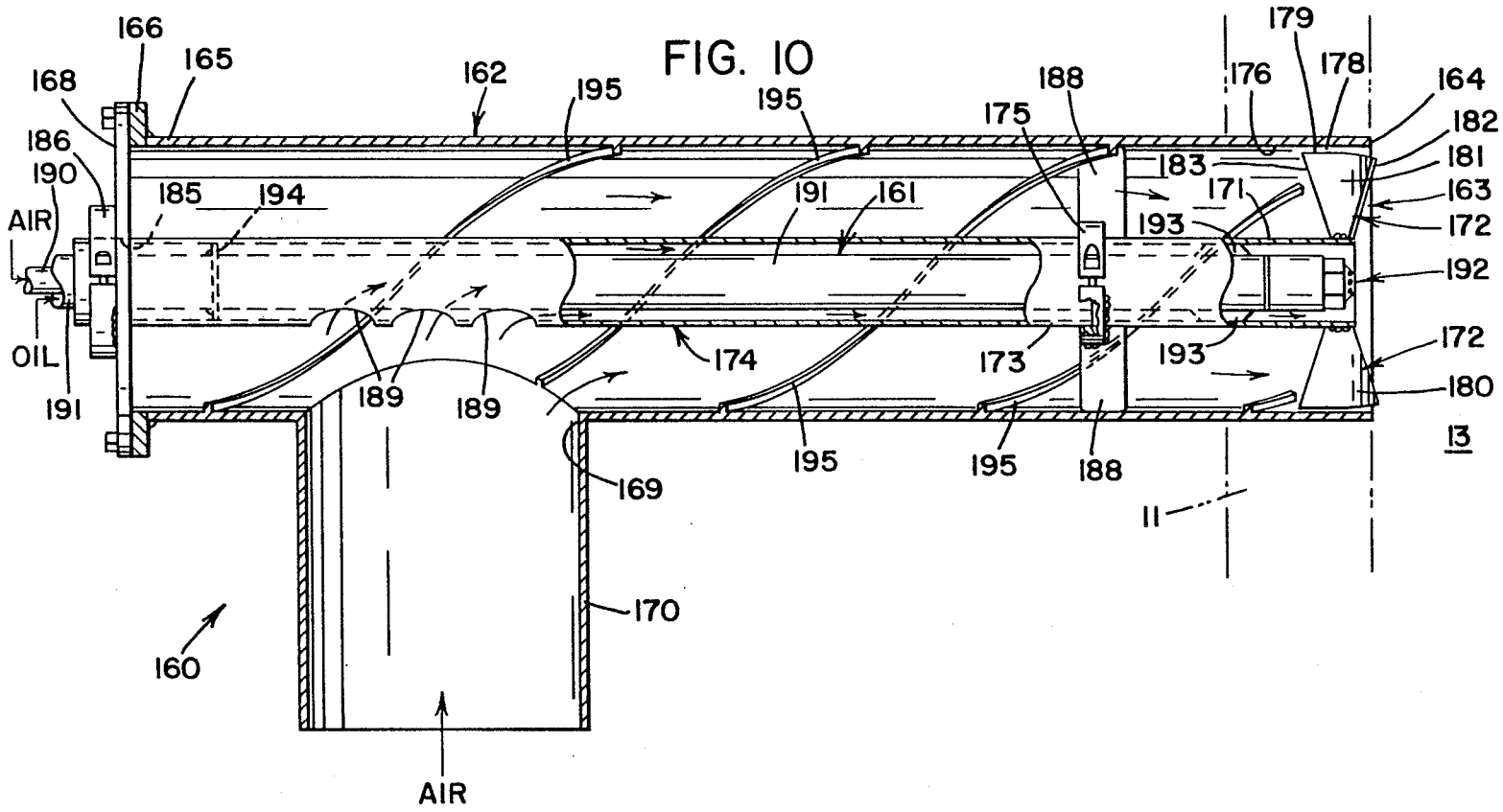
FIG. 10 is an enlarged side elevation, partially in section, depicting a fourth embodiment of burner assembly according to the present invention.

With reference to FIG. 10, a fourth burner assembly 160 is depicted. It comprises a fuel or oil gun 161, housing means 162 by which the oil gun 161 is supported and a first supply of air is supplied and an air swirler 163. The housing member 162 has a diameter of between eight to 16 inches (20 to 40 cm). It is to be understood once again that burner assembly 160 is not limited by these dimensions. Housing member 162 passes through the furnace wall 11 and is open at end 164 to the furnace interior. At the opposite end 165, a flange 166 is provided to which the closure plate 168 is removably affixed. An opening 169 in the side of the housing receives a leg 170 which is connected to the wind box 20 and receives a large volume of air. The leg 170 is affixed to the housing 162 perpendicularly or at an angle.

It can be seen in FIG. 10 that a first volume of air is fed into the housing 162 through the leg 170 to exit out the end 164 directly into the furnace interior. Rather than deliver a forward moving blast of air, the swirler 163 is provided in the opening. The swirler, which comprises a cylindrical hub 171 and a plurality of blades 172, is affixed to the end 173 of a holding tube 174 with a clamping device 175. The blades 172 extend radially outwardly toward the inner wall 176 of housing 162.

A narrow axial space 178 is provided between the outermost edge 179 of each blade 172 and inner wall 176 to allow some of the air moving through housing 162 to flow around the swirler 163. Again, use of a larger diameter swirler, the elimination of an outer ring around the blades and provision of the space 178 has resulted in greater control over the flame pattern and efficiency of the combustion. The swirler is essentially identical to the swirlers previously described, each blade having a convex face 180, a concave rear 181 and trailing and leading edges 182 and 183. Hence, a separate view has not been presented.

The holding tube 174 passes through a bore 185 in the closure plate 168. A suitable fastening device 186 can be employed to maintain tube 174 in position and one or more spiders 188 can be used for support. A plurality of axial ports 189 are provided in the side of tube 174 so that it too receives air from the air box 20, which eliminates the need for a separate air supply.

The oil gun 161 is a conventional element and includes an air line 190 which passes concentrically within an oil line 191. Both the air and fuel pass separately through the gun until reaching the atomizer tip 192 where mixing takes place by atomization of the oil which is injected under pressure as a stream into the furnace interior 13. Although the present invention can employ an improved atomizer tip described hereinbelow, generally speaking, the oil gun 161 having a standard atomizer 192 can be utilized with the burner assembly 10.

The oil gun 161 is centered within the holding tube 174 by one or more spiders 193. A baffle plate 194 can be welded to the oil line 191 to form a seal within holding tube 174 so that the flow of air through the ports 189 will travel along the oil gun to be released within the atomized fuel mixture.

To help impart a rotational movement to the air passing through the housing member 162 before it contacts the swirler 163, a plurality of helical lands 195 are formed at the time of forging or they may be welded to the inner wall 176. Of course, they can also be provided in the housing members of the other burner assemblies although not depicted in the drawings.

With reference now to FIGS. 11 and 12, a conventional atomizer tip 200 such as tips 58, 89, 155 and 192 noted hereinabove is described in greater detail. The tip 200 provides a base flange 201 which is gripped by the ring 202 of a capnut 203 threadably affixed to the oil line 204. A central flow of air is fed through line 205 to enter a central chamber 206. A plurality of angled passageways 208 pass outwardly from the chamber 206 to the face 209 of tip 200. Simultaneously, oil or other fuel is fed through the passageway 210, outside of the air line where it enters a plurality of radially inwardly directed passageways 211 which terminate in the air passageways 208. As fuel exits passageways 211, it is immediately sheared by the air in passageways 208 forming atomized particles which exit with the air. Although the design may be altered to provide oil centrally and air in the outside line, with the use of a distributor plug to direct the oil to the exterior, the tip 200 is customary in providing atomized fuel.

The present invention also provides an improved atomizer tip 215, depicted in FIGS. 13 and 14. It provides a base flange 216, gripped by the ring 218 of a capnut 219 threadably affixed to the oil line 220. A central flow of air is fed through line 221 to enter a central chamber 222. A plurality of angled passageways 223 and 224 pass outwardly from the chamber 222 to the face 225 of tip 215. Simultaneously, oil or other fuel is fed through the passageway 226, outside of the air line where it enters a plurality of radially inwardly directed passageways 228 which terminate in the air passageways 223. As fuel exits passageways 228, it is immediately sheared by the air in passageways 223 forming atomized particles which exit with the air. Additionally, more air is fed directly at the atomizer tip via passageways 224 which do not intercommunicate with any of the oil passageways. Air actually is the atomizing medium for atomizer tip 215 because that portion fed through passageways 224 is employed to support combustion of the fuel.

Thus, it should be clear that the present invention succeeds in providing several improved burner assemblies, each one employing structure that delivers usable air in the immediate vicinity of the atomized stream of fuel particles. Use of the foregoing burner assemblies facilitates the method of the present invention which supplies air to fuel and air mixtures to provide increased combustion efficiency. As noted hereinabove, such a method is practiced by injecting a mixture of fuel and an atomized medium from a fuel gun, e.g., 25 into the interior 13 of a furnace, feeding a first flow of air B through the burner assembly and into the furnace interior, interrupting the first flow of air so that portions thereof move axially forward into the furnace interior while another portion is imparted a rotation and, encompassing the mixture with the first flow of air as the mixture enters the furnace whereby both portions of the first flow of air break up the mixture within the furnace.

Finally, with respect to FIGS. 15A–15D, the effect of the method of the present invention has been depicted by a comparison of flame patterns existing heretofore with a flame pattern (FIG. 15D) from a burner assembly described herein.

Figure 15A:
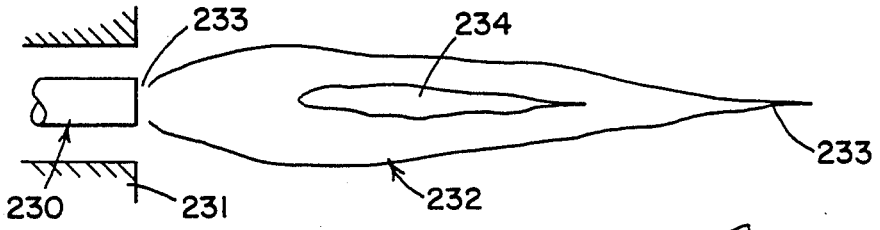
FIGS. 15A–15C depict flame patterns usually obtained with existing burner assemblies and FIG. 15D depicts a properly controlled flame pattern obtained with any of the burner assemblies of the present invention.
Figure 15B:
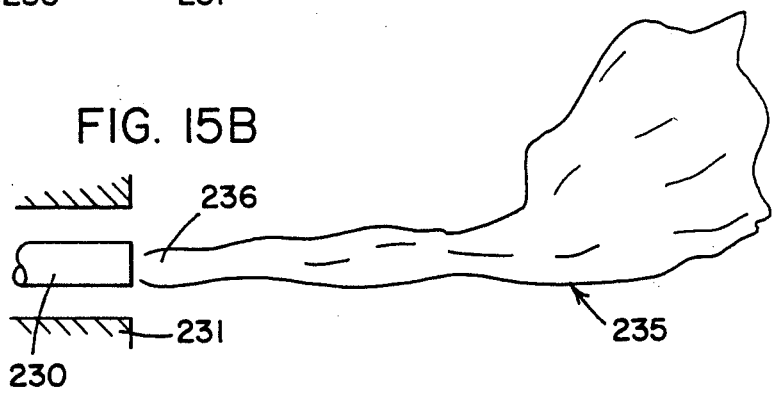
Figure 15C:
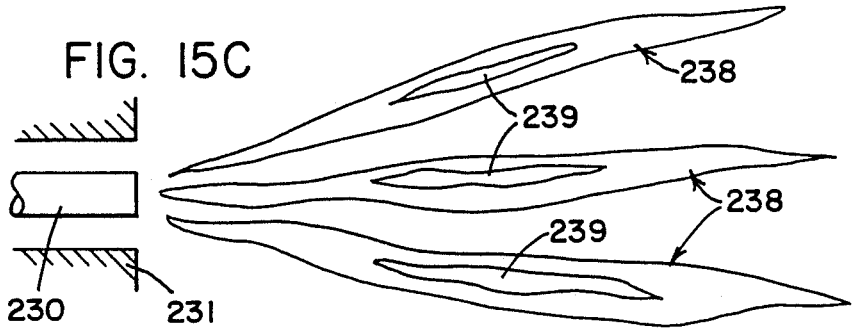

FIGS. 15A–15C each depict a fuel gun 230 passing through a furnace wall 231 and one of three typical flame patterns that result from a lack of controlled combustion. In FIG. 15A, the flame 232 is narrow and drawn out, resembling a torch. This results from high internal air velocity, limited air and little to no mixing of air and fuel. Hence, combustion is poor. There is no burning occurring at areas 233 and the core 234 shows incomplete combustion.

In FIG. 15B, the flame 235 is lazy and smokey. It is caused by low to no internal air velocity, limited air and no mixing. Again, combustion is generally poor. No burning occurs at region 236 beyond the atomizer tip.

In FIG. 15C, the flame 238 extends out in long, narrow fingers of partially burned oil, typically caused by limited or no air, incorrect velocities and no mixing.

Again, combustion is poor and a smokey flame results. The centers 239 are poor burning.

Figure 15D:
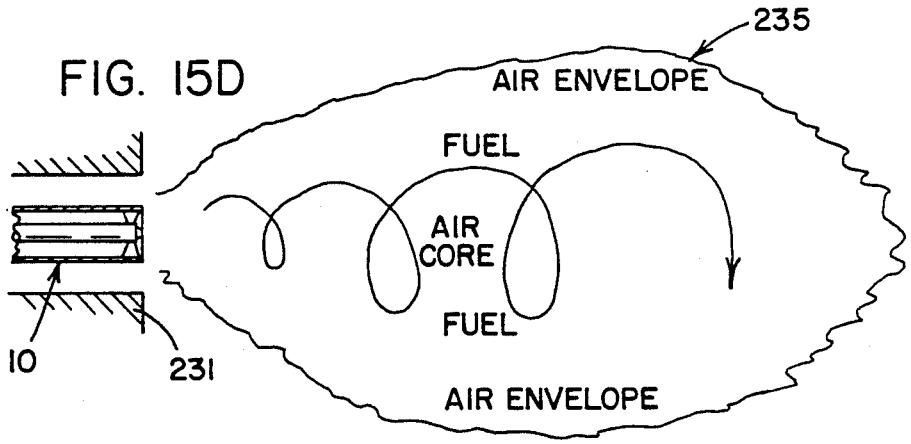

In FIG. 15D, the flame 235 has been properly controlled and combustion is complete. It will be noted that the flame is large and bushy and that combustion begins essentially at the atomizer tip of the burner assembly 10, or the like described herein. Air velocities and amounts are correct and the air core and air envelopes are forced to mix with the atomized oil.

Thus, it should be clear to those skilled in the art the manner in which the various burner assemblies described herein are constructed, assembled and used. It should also be clear that the atomizer tip 215 is novel and may be utilized with any of the burner assemblies of this invention as well as in existing assemblies.

Based upon the foregoing disclosure, it should now be apparent that the use of the assemblies described herein will carry out the objects set forth hereinabove. It should also be apparent to those skilled in the art that the burner assemblies of the subject invention can readily be utilized in conjunction with various types of furnaces and that the most basic assembly 75 can be modified with the provision of a holding tube to route a second volume of air; an additional swirler can be added and the helical lands discussed in conjunction with assembly 160 can be employed with any of the assemblies.

Although approximate sizes have been disclosed for each of the burner assemblies, none of the ranges should be interpreted as limiting. As noted hereinabove, there may exist situations where a smaller or larger burner assembly may be interchanged for a previous assembly such as where more or less heat input is desired, size constraints are present or the like. Thus, it is believed that those skilled in the art can determine the design of burner assembly that will be most usable from the total specification disclosure provided herein.

It is, therefore, to be understood that any variations evident fall within the scope of the claimed invention and thus, the selection of specific component elements can be determined without departing from the spirit of the invention herein disclosed and described. Moreover, the scope of the invention shall include all modifications and variations that may fall within the scope of the attached claims.

We claim:

1. A burner assembly for the combustion of liquid fuels in furnaces and the like comprising:

fuel gun means carrying an atomizer tip providing a plurality of small passageways open directly to said furnace interior through which a mixture of combustible fuel and an atomizing medium is injected directly into the interior of said furnace;

housing means supplying a first flow of air into said furnace to encompass said injected fuel mixture therein having an end open directly to said furnace interior and encompassing said atomizer tip, said housing means being attachable to said furnace, so that said combustible fuel mixture is delivered directly to the interior of said furnace for combustion;

holding tube means carrying said fuel gun means and carried within said housing means for supplying a second flow of air unrestricted, directly into said furnace interior separate from said first flow of air; and swirler means having a plurality of overlapping blades, carried by said holding tube, foreclosing direct axial passage of the majority of said first flow of air therethrough, extending radially outwardly from said holding tube, terminating with a free outermost edge spaced a short distance from said housing means and providing a narrow axial space for the passage of a minor portion of said first flow of air, each said blade having a leading edge and a trailing edge, said blades being arranged so that said trailing edge of each said blade overlaps said leading edge of the adjacent blade.

2. A burner assembly, as set forth in claim 1, wherein said housing means comprises a cylindrical tube having an inner wall and is open to said furnace interior at one end and is closed at the opposite end.

3. A burner assembly, as set forth in claim 2, wherein said holding tube means pass through said closed end of said housing means and open to said furnace interior at said open end of said housing means.

4. A burner assembly, as set forth in claim 3, wherein said housing means provides an axial port to which a leg is attached through which said first flow of air is fed.

5. A burner assembly, as set forth in claim 4, wherein said holding tube provides axial port means through which said second flow of air is fed.

6. A burner assembly, as set forth in claim 5, further including air line means connected to said axial port means, extending into said leg means and open thereto.

7. A burner assembly, as set forth in claim 1, wherein at least some of said passageways provide a mixture of fuel and air.

8. A burner assembly, as set forth in claim 1, wherein all of said passageways provide a mixture of fuel and air.

9. A burner assembly, as set forth in claim 3, wherein said swirler means is carried by said holding tube means adjacent said open end thereof.

10. A burner assembly, as set forth in claim 2, further including a plurality of helical lands carried by said inner wall of said housing means, partially to alter the direction of movement of said first flow of air.

11. A burner assembly, as set forth in claim 5, further comprising second swirler means having a plurality of overlapping blades, foreclosing direct axial passage of said second flow of air therethrough, extending radially outwardly from said fuel gun means, terminating with a free outermost edge spaced a short distance from said holding tube and providing a narrow axial space for the movement of a minor portion of said second flow of air, each said blade having a leading edge and a trailing edge, said blades being arranged so that said trailing edge of each said blade overlaps said leading edge of the adjacent blade.

12. A burner assembly, as set forth in claim 11, wherein said second swirler means is carried by said fuel gun, upstream from said atomizer tip.

13. A burner assembly, as set forth in claim 12, wherein said fuel gun means provides an atomizer tip providing a plurality of small passageways open to said furnace interior.

14. A burner assembly, as set forth in claim 13, wherein at least some of said passageways provide a mixture of fuel and air.

15. A burner assembly, as set forth in claim 13, wherein all of said passageways provide a mixture of fuel and air.

16. A burner assembly, as set forth in claim 11, further including a plurality of helical lands carried by said inner wall of said housing means, partially to alter the direction of movement of said first flow of air.

17. A burner assembly for the combustion of liquid fuels in furnaces and the like comprising:

fuel gun means carrying an atomizer tip providing a plurality of small passageways open directly to said furnace interior through which a mixture of combustible fuel and an atomizing medium is injected directly into the interior of said furnace;

housing means supporting said fuel gun means and supplying a first flow of air into said furnace to encompass said injected fuel mixture therein having an end open directly to said furnace interior and encompassing said atomizer tip, said housing means being attachable to said furnace, so that said combustible fuel mixture is delivered to the interior of said furnace for combustion and swirler means having a plurality of overlapping blades carried by said fuel gun means, foreclosing direct axial passage of said first flow of air therethrough, extending radially outwardly from said fuel fun means, terminating with a free outermost edge spaced a short distance from said housing means and providing a narrow axial space for the movement of a minor portion of said first flow of air, each said blade having a leading edge and a trailing edge, said blades being arranged so that said trailing edge of each said blade overlaps said leading edge of the adjacent blade.

18. A burner assembly, as set forth in claim 17, wherein said housing means comprises a cylindrical tube having an inner wall and is open to said furnace interior at one end and is closed at the opposite end.

19. A burner assembly, as set forth in claim 18, wherein said fuel gun means passes through said housing means and is partially supported thereby.

20. A burner assembly, as set forth in claim 19, wherein said housing means provides an axial port to which a leg is attached through which said first flow of air is fed.

21. A burner assembly, as set forth in claim 19, further including a plurality of helical lands carried by said inner wall of said housing means, partially to alter the direction of movement of said first flow of air.

22. A burner assembly, as set forth in claim 17, wherein at least some of said passageways provide a mixture of fuel and air.

23. A burner assembly, as set forth in claim 17, wherein all of said passageways provide a mixture of fuel and air.

24. A burner assembly, as set forth in claim 17, wherein said swirler means is carried by said fuel gun, upstream from said atomizer tip.

25. A method for supplying liquid fuel and air mixtures to furnaces and the like through a burner assembly having liquid fuel gun means, housing means attachable to the furnace and a plurality of curved, overlapping blades comprising the steps of:

locating the tip of said fuel gun means directly at an opening in said furnace;

injecting a mixture of liquid fuel and atomizing medium through said tip directly into the interior of said furnace;

feeding a first flow of air through said housing means and into said furnace interior;

providing said plurality of curved, overlapping blades within said housing means and directly adjacent said furnace interior, each said blade having a leading edge, a trailing edge and a free outermost edge terminating a short distance from said housing means;

directly said first flow of air through a plurality of curved slotted passageways formed by said overlapping blades which foreclose direct axial passage of the major volume of said first flow of air between adjacent blades along their entire length;

allowing said major volume of air to expand radially as it passes through said curved slotted passageways and into said furnace interior;

directing the remaining minor volume of air around said blade edges to flow unrestricted between said blade edges and said housing means and combine with said radially expanding air as said major and minor volumes move forward within said furnace; and encompassing said mixture with said first flow or air as said mixture enters said furnace whereby both said volumes break up said mixture within said furnace.

26. A method, as set forth in claim 25, including the additional step of feeding a second flow of air through said burner assembly and into said furnace interior separate from said first flow of air.

27. A method, as set forth in claim 26, wherein said second flow of air is moved axially through said burner assembly and directly into said furnace between said mixture and said first flow of air.

28. A method, as set forth in claim 27, including the additional steps of supplying a single volume of air to said burner assembly; and dividing said air into said first and second flows within said assembly.

29. A method, as set forth in claim 28, including the additional step of:

interrupting said second flow of air to provide a major volume and a minor volume;

directing said major volume through a plurality of curved slotted passageways formed by a plurality of overlapping blades which foreclose direct axial passage between adjacent blades along their entire length;

allowing said major volume of air to expand radially as it passes through said curved slotted passageways;

directing said minor volume around the circumferential edge of said blades to flow unrestricted and combine with said radially expanding air as said major and minor volumes move forward into said furnace interior.

30. A method, as set forth in claim 25, wherein said step of injecting includes the steps of forcing a volume of air as said atomizing medium through a first plurality of narrow air passageways which extend through an atomizer tip; and forcing a volume of duel through a plurality of narrow fuel passageways which communicate with said first plurality of air passageways whereby said fuel becomes atomized by said air as it is ejected from said first plurality of passageways.

31. A method, as set forth in claim 30, including the additional step of forcing a portion of said volume of air through a second plurality of narrow air passageways which extend through said atomizer tip.

* * * * *

UNITED STATES PATENT AND TRADEMARK OFFICE

CERTIFICATE OF CORRECTION

PATENT NO. : 4,952,136

DATED : August 28, 1990

INVENTOR(S) : Raymond L. Collins, Jr. and Stephen A. Bryk

It is certified that error appears in the above-identified patent and that said Letters Patent is hereby corrected as shown below:

Column 8, line 50, "conjunction" should read -- conjunction --

Column 9, lines 2 and 3, should read as one continuous paragraph

Column 14, claim 25, line 3, "directly" should read -- directing --

Column 14, claim 26, lines 25 and 26, should read as one continuous paragraph

Column 14, claim 30, line 59, "duel" should read -- fuel --

Signed and Sealed this

Twenty-second Day of December, 1992

*Attest:*

DOUGLAS B. COMER

*Attesting Officer*

*Acting Commissioner of Patents and Trademarks*